US012232536B2

(12) United States Patent
Chen

(10) Patent No.: US 12,232,536 B2
(45) Date of Patent: Feb. 25, 2025

(54) POROUS LIQUID CONDUCTING MEMBER WITH SMOOTH LIQUID CONDUCTION, AND HEATING ASSEMBLY AND ATOMIZING DEVICE THEREWITH

(71) Applicant: Shenzhen Huachengda Precision Industry Co. Ltd., Guangdong (CN)

(72) Inventor: Ping Chen, Guangdong (CN)

(73) Assignee: Shenzhen Huachengda Precision Industry Co. Ltd., Shenzhen (CN)

( * ) Notice: Subject to any disclaimer, the term of this patent is extended or adjusted under 35 U.S.C. 154(b) by 331 days.

(21) Appl. No.: 17/764,976

(22) PCT Filed: Sep. 28, 2020

(86) PCT No.: PCT/CN2020/118554
§ 371 (c)(1),
(2) Date: Mar. 29, 2022

(87) PCT Pub. No.: WO2022/061926
PCT Pub. Date: Mar. 31, 2022

(65) Prior Publication Data

US 2022/0361579 A1 Nov. 17, 2022

(51) Int. Cl.
*A24F 40/48* (2020.01)
*A24F 40/10* (2020.01)
(Continued)

(52) U.S. Cl.
CPC ..... *A24F 40/485* (2020.01); *A24F 40/10* (2020.01); *A24F 40/44* (2020.01); *A24F 40/46* (2020.01)

(58) Field of Classification Search
CPC ..... A24F 40/485; A24F 40/10; A24F 40/44; A24F 40/46; A24F 40/42
See application file for complete search history.

(56) References Cited

U.S. PATENT DOCUMENTS 11,961,998 B2 * 4/2024 Lin ..... H01M 4/134
2021/0100287 A1 * 4/2021 Huang ..... H05B 3/10
2023/0337749 A1 * 10/2023 Tang ..... A24F 40/10

FOREIGN PATENT DOCUMENTS

CN 109452691 A 3/2019
CN 209376696 U 9/2019
(Continued)

OTHER PUBLICATIONS

European Search Report of Counterpart European Patent Application No. 20954321.4 issued on Nov. 7, 2023.

*Primary Examiner* — Truc T Nguyen

(57) ABSTRACT

A porous liquid conducting member with a smooth liquid conduction is provided, the liquid conducting member is of a porous material and provided with a hollow cavity therein, and includes an inner side and an outer side. The inner side or the outer side is configured to be in contact with a liquid, and is provided with an air exchange recess to form a thin-wall on the liquid conducting member. A wall thickness of the thin-wall is smaller than a wall thickness between the inner side and the outer side, enabling air to be conducted through the thin-wall. The air exchange recess is outside a heating area of the liquid conducting member, so that air can enter the liquid storage chamber through the air exchange recess during an atomizing process, to avoid porous channels in the heating area from being occupied by the air entering the liquid storage chamber.

18 Claims, 11 Drawing Sheets

(51) Int. Cl.

| | |
|---|---|
| ***A24F 40/44*** | (2020.01) |
| ***A24F 40/46*** | (2020.01) |
| ***A24F 40/485*** | (2020.01) |

(56) References Cited

FOREIGN PATENT DOCUMENTS

| | | | | | |
|---|---|---|---|---|---|
| CN | 110338466 | | * | 10/2019 | ..... A24F 47/008 |
| CN | 110338466 | A | | 10/2019 | |
| CN | 209768989 | U | | 12/2019 | |
| CN | 209931490 | U | | 1/2020 | |
| CN | 210432836 | U | | 5/2020 | |
| WO | WO2023035152 | | * | 3/2023 | ..... A24F 40/44 |

* cited by examiner

POROUS LIQUID CONDUCTING MEMBER WITH SMOOTH LIQUID CONDUCTION, AND HEATING ASSEMBLY AND ATOMIZING DEVICE THEREWITH

TECHNICAL FIELD

The present disclosure relates to the field of heating and atomizing technology using a porous liquid conducting member, in particular to a porous liquid conducting member with a smooth liquid conduction, and a heating assembly and an atomizing device therewith.

DESCRIPTION OF RELATED ART

A porous liquid conducting member is typically used to conduct liquid in an atomizing assembly, and is often applied in an atomizing device to conduct the liquid in the atomizing device to a heating member for atomization. Generally, one side or one surface of the liquid conducting member is in contact with the liquid, and another surface of the liquid conducting member is provided with the heating member in contact with the outside air. The liquid conducting member is configured to conduct the liquid in the atomizing device to the heating member for heating and atomizing, the porous structure in the liquid conducting member is configured as channels to communicate the liquid in a liquid storage chamber in an atomizer with the outside air, and the liquid is mainly transmitted via the porous channels in the liquid conducting member. In an actual use process, with the consumption of the liquid, the liquid in the liquid storage chamber is consumed, and an air pressure in the liquid storage chamber will be smaller than the outside atmospheric pressure. When the air pressure difference is too large, the outside air will be transmitted to the liquid storage chamber via the porous channels in the porous liquid conducting member, so that the air will occupy a part of the porous channels in the liquid conducting member. If the air happens to occupy the porous channels in a heating area, the heating member in the heating area will have a poor liquid conducting since the liquid cannot be transmitted to the heating member in time, and as a result, the heating member will be scorched due to a local high temperature, which will affect the user experience.

SUMMARY OF THE DISCLOSURE

The present disclosure aims to provide, in view of the above-described deficiencies of the prior art, a porous liquid conducting member having a structure of liquid conducting and air exchange separated, to separate porous channels in the porous liquid conducting member for the liquid supply from that for the air exchange, thereby to achieve a smoother liquid conducting in a heating area.

A technical solution adopted by the present disclosure is to provide a liquid porous liquid conducting member with a smooth liquid conduction, wherein the liquid conducting member is made of a porous material, and is provided with a hollow cavity therein, and includes an inner side and an outer side; the inner side or the outer side is configured to be in contact with a liquid, and is provided with an air exchange recess to form a thin-wall on the liquid conducting member; a wall thickness of the thin-wall is smaller than a wall thickness between the inner side and the outer side, enabling air to be conducted through the thin-wall.

In an embodiment, the air exchange recess is in a hole shape or a groove shape.

In an embodiment, the hollow cavity is a liquid storage groove defined in an upper side of the liquid conducting member.

In an embodiment, the air exchange recess is located in a bottom of the liquid storage groove; a liquid supply hole is provided in a bottom of the liquid storage groove, and the liquid supply hole is a blind hole; and the wall thickness of the thin-wall formed by the air exchange recess is smaller than a wall thickness between a bottom of the liquid supply hole and an outer side of the liquid conducting member.

In an embodiment, the thin-wall is a wall between a bottom of the air exchange recess and a lower surface of the liquid conducting member.

In an embodiment, the thin-wall is a wall between a side wall of the air exchange recess and the outer side of the liquid conducting member.

In an embodiment, a size of one end of the liquid conducting member provided with the liquid storage groove is larger than that of an opposite end of the liquid conducting member, so that the liquid conducting member is in a stepped shape.

In an embodiment, the air exchange recess is located in a side wall of the liquid storage groove.

In an embodiment, the air exchange recess is located in an outer side of the liquid conducting member.

In an embodiment, the hollow cavity extends through the liquid conducting member, and the liquid conducting member is tubular or annular, and the air exchange recess is located in an outer side wall or an inner side wall of the liquid conducting member.

In an embodiment, the wall thickness of the thin-wall formed by the air exchange recess is 0.1 mm to 0.5 mm.

In an embodiment, an area of each thin-wall formed by each corresponding air exchange recess is 0.05-15 $mm^2$.

In an embodiment, a porosity of the liquid conducting member is 20% to 80%.

In an embodiment, an average micropore diameter of the liquid conducting member is 5 μm to 50 μm.

A technical solution adopted by the present disclosure is to further provide a heating assembly, including the porous liquid conducting member with the smooth liquid conduction described above, and further including a heating member disposed on the liquid conducting member, and a heating area of the heating member is not located at the thin-wall formed by the air exchange recess.

A technical solution adopted by the present disclosure is to further provide an atomizing device, including a housing and the above heating assembly disposed in the housing; wherein a liquid storage chamber is defined in the housing, and is communicated with the hollow cavity in the liquid conducting member, so that liquid in the liquid storage chamber can enter the hollow cavity and is further conducted to the heating member through the liquid conducting member, and air can enter the liquid storage chamber through the air exchange recess.

By implementing the present disclosure has at least the following beneficial effects: in the porous liquid conducting member with the smooth liquid conduction, and the heating assembly and the atomizing device in the present disclosure, the porous channels for the liquid supply and for the air exchange in the porous liquid conducting member are separated, thereby a smoother liquid conducting in a heating area is achieved.

BRIEF DESCRIPTION OF THE DRAWINGS

The present disclosure will be further described below in conjunction with the attached drawings and embodiments, and in the drawings.

Figure 1:
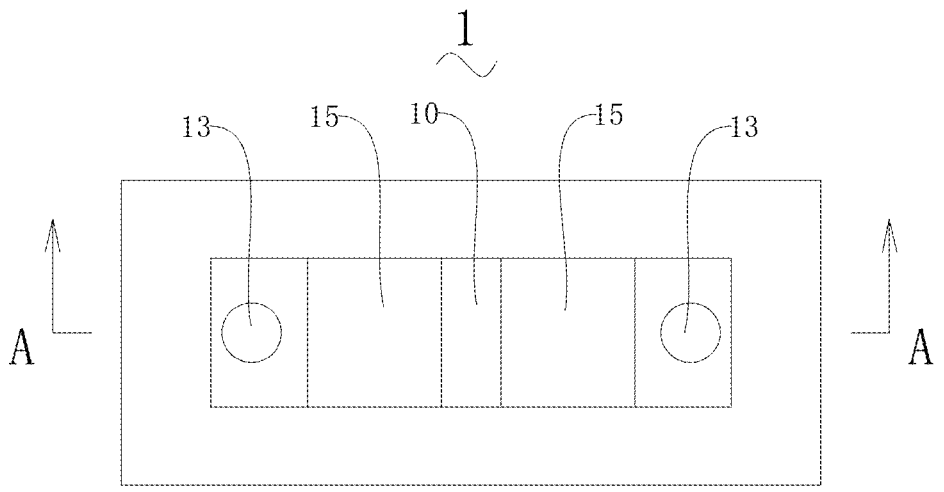
FIG. 1 is a top view of a liquid conducting member in a first embodiment of the present disclosure.

Wherein, the reference marks in the drawings represent: liquid conducting member, 1; hollow cavity, 10; inner side, 11; outer side, 12; air exchange recess, 13; thin-wall, 14; thickness of thin-wall, a; wall thickness between bottom of liquid supply hole 15 and outer side of liquid conducting member 1, b; liquid supply hole, 15; heating member, 2; heating area, 21; liquid, 3.

DESCRIPTION OF THE EMBODIMENTS

For better understanding of the technical features, objects and effects of the present disclosure, the specific embodiments of the present disclosure will be described in detail with reference to the accompanying drawings. It should be understood that the orientation or the position relationship indicated by relative terms such as "front", "back", "upper", "lower", "left", "right", "longitudinal", "lateral", "vertical", "horizontal", "top", "bottom", "inner", "outer", "head", and "tail" should be construed to refer to the orientation or the position relationship as then described or as illustrated in the drawings under discussion. These relative terms are for convenience of description and do not require that the present disclosure be constructed or operated in a particular orientation. It should be further noted that, in the present disclosure, unless specified or limited otherwise, the terms "mounted", "connected", "coupled", "fixed", "arranged", "disposed" and the like are used broadly, and can be, for example, fixed connections, detachable connections, or integral connections; can also be direct connections or indirect connections via intervening structures; can also be inner communications of two elements. When one component is described to be "located on" or "located below" another component, it means that the component can be "directly" or "indirectly" located on another component, or there may be one or more intervening component located therebetween. The terms "first", "second", "third" and the like are only used for the convenience of describing the technical solution, and cannot be understood as indicating or implying the relative importance or implicitly indicating the number of the indicated technical features. Therefore, features defined with "first", "second", "third", etc. may explicitly or implicitly indicates that one or more of these features can be included. For those of ordinary skill in the art, the specific meaning of the above-mentioned terms in the present disclosure can be understood according to specific circumstances.

In the description hereinbelow, for purposes of explanation rather than limitation, specific details such as specific systematic architectures and techniques are set forth in order to provide a thorough understanding of the embodiments of the present disclosure. However, it will be apparent to persons skilled in the art that the present disclosure may also be implemented in absence of such specific details in other embodiments. In other instances, detailed descriptions of well-known systems, devices, circuits, and methods are omitted so as not to obscure the description of the present disclosure with unnecessary detail.

Figure 2:
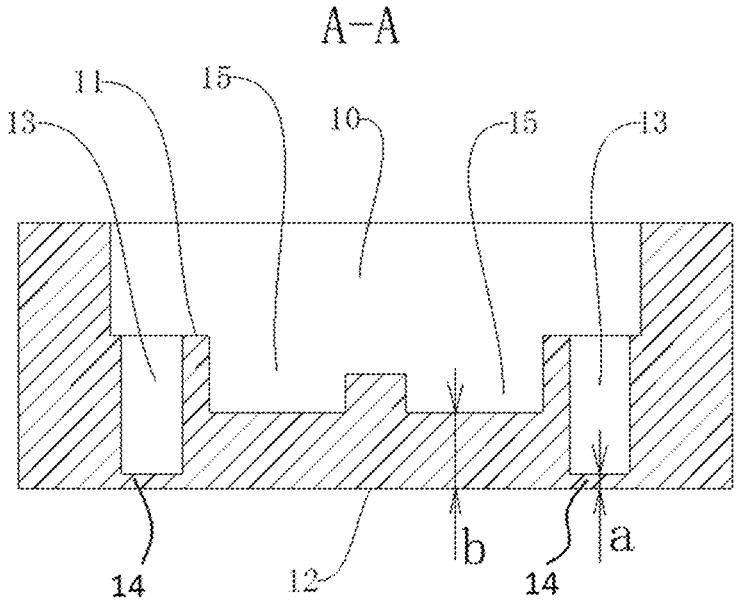
FIG. 2 is an A-A sectional view of FIG. 1.
Figure 5:
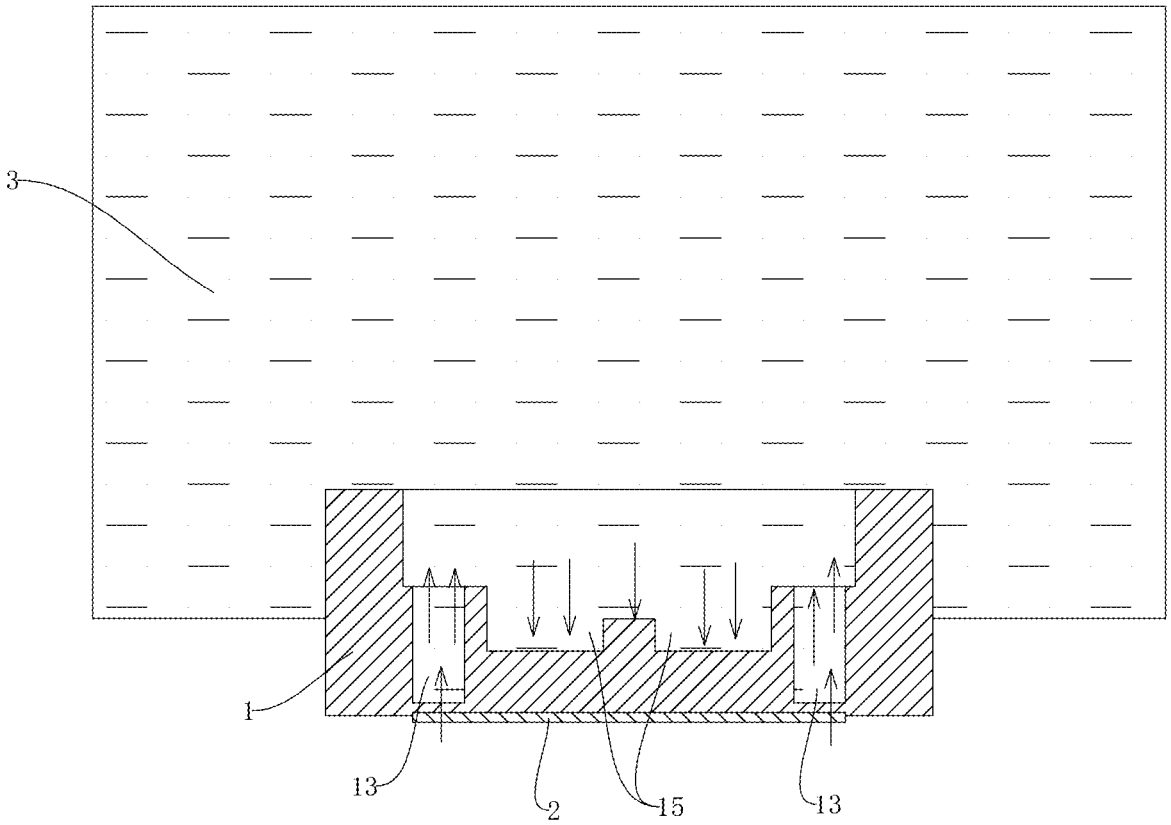
FIG. 5 is a schematic diagram showing a liquid conduction and an air conduction when the liquid conducting member and the heating member are in contact with the liquid (wherein, arrows in liquid supply holes indicate a direction of the liquid conduction, and arrows in air exchange recesses indicate a direction of the air conduction)

As shown in FIGS. 1 to 2 and FIG. 5, a porous liquid conducting member 1 with a smooth liquid conduction in an embodiment of the present disclosure is made of a porous material, preferably a ceramic material. The liquid conducting member 1 is provided with a hollow cavity 10 therein, and includes an inner side 11 and an outer side 12. The inner side 11 or the outer side 12 is configured to be in contact with a liquid 3, and is provided with an air exchange recess 13 to form a thin-wall 14 on the liquid conducting member 1. A wall thickness of the thin-wall 14 is smaller than a wall thickness between the inner side 11 and the outer side 12, so that air can be conducted from the inside to the outside of the liquid conducting member 1 or from the outside to the inside of the liquid conducting member 1 through the thin-wall 14. The air exchange recess 13 is in a hole or groove shape.

Generally, when the liquid conducting member 1 is applied to an atomizing device, a heating member 2 is provided on the liquid conducting member 1, a heating area 21 of the heating member 2 is located at a position staggered from the thin-wall 14, and the inner side 11 or the outer side 12 of the liquid conducting member 1 is configured to be in contact with the liquid 3 in a liquid storage chamber of the atomizing device, and the liquid conducting member 1 conducts the liquid 3 to the heating member 2 for heating and atomizing. During the atomization process of the atomizing assembly, the liquid 3 in the liquid storage chamber will be consumed. Due to that the liquid storage chamber is in a sealed state, with the consumption of the liquid 3, a space in the liquid storage chamber becomes larger and an internal air pressure in the liquid storage chamber becomes smaller than an external atmospheric pressure. Besides, the air can only enter the liquid storage chamber via porous channels in the porous liquid conducting member 1. By providing the air exchange recess 13, the air will enter the liquid storage chamber through the thin-wall 14 of the air exchange recess 13, so as to avoid the porous channels in the liquid conducting member 1 at the heating area 21 from being occupied by the air when the air enters the liquid storage chamber, so that all micropores in the liquid conducting member 1 corresponding to the heating area 21 are used to transmit the liquid 3, and the porous channels for the liquid supply and for the air exchange in the porous liquid conducting member 1 are separated, so as to achieve a more smooth liquid conduction in the heating area 21. The principle is that at the thin-wall 14 formed by the air exchange recess 13 of the porous liquid conducting member 1, the thickness of the thin-wall 14 is small, and the length of each porous channel is small, thus the external air can enter the liquid storage chamber via the porous channels in the thin-wall 14 when the pressure difference between the liquid storage chamber and the external air is relatively small.

Referring to FIGS. 1-14, in these embodiments, the liquid conducting member 1 is in a rectangle shape, and the hollow cavity 10 is a liquid storage groove disposed in an upper side of the liquid conducting member 1.

Referring to FIGS. 1-2 and FIG. 5, in this embodiment, the air exchange recess 13 is located at a bottom of the liquid storage groove, a bottom of the liquid storage groove is provided with liquid supply holes 15, each liquid supply hole 15 is a blind hole, and the wall thickness a of the thin-wall 14 formed by the air exchange recess 13 is smaller than the wall thickness b between the bottom of the liquid supply hole 15 and the lower side of the liquid conducting member 1. The depth of the air exchange hole is larger than the depth of the short-distance liquid supply hole 15. Each thin-wall 14 is a wall between the bottom of the corresponding air exchange recess 13 and a lower surface of the liquid conducting member 1, and each air exchange recess 13 is a blind hole, so that the air can pass through the thin-wall 14 to the air exchange recess 13 from the outside and then enter the liquid storage groove.

The large liquid storage groove is able to store more liquid 3 to supply to the liquid conducting member for absorption after consumption. More than one short-distance liquid supply hole 15 is provided in the large liquid storage groove, so that the liquid 3 can reach the heating member on the outer side of the liquid conducting member more conveniently with a shorter distance.

The principle is: when the liquid conducting member 1 is applied in the atomizing device, the liquid conducting member 1 is provided with the heating member 2, and the position of the air exchange recess is outside the heating area of the heating member. The deeper air exchange recess 13 forms the thin-wall 14, so that a wall thickness difference is formed between the wall thickness of the liquid conducting member 1 corresponding to the heating area 21 and that corresponding to the non-heating area 21 of the heating member 2. In this way, the position with a thinner wall thickness has a shorter micropore path than that with a thicker wall thickness, and thus has a smaller pressure required for the air. When the pressure in the liquid storage chamber is smaller than the atmospheric pressure, the air can enter the liquid storage chamber through the thin-wall 14 of the air exchange recess 13, so that the air will not occupy the micropores in the liquid conducting member 1 corresponding to the heating area 21, and thus the liquid conducting member 1 corresponding to the heating area 21 can supply liquid more smoothly.

Figure 6:
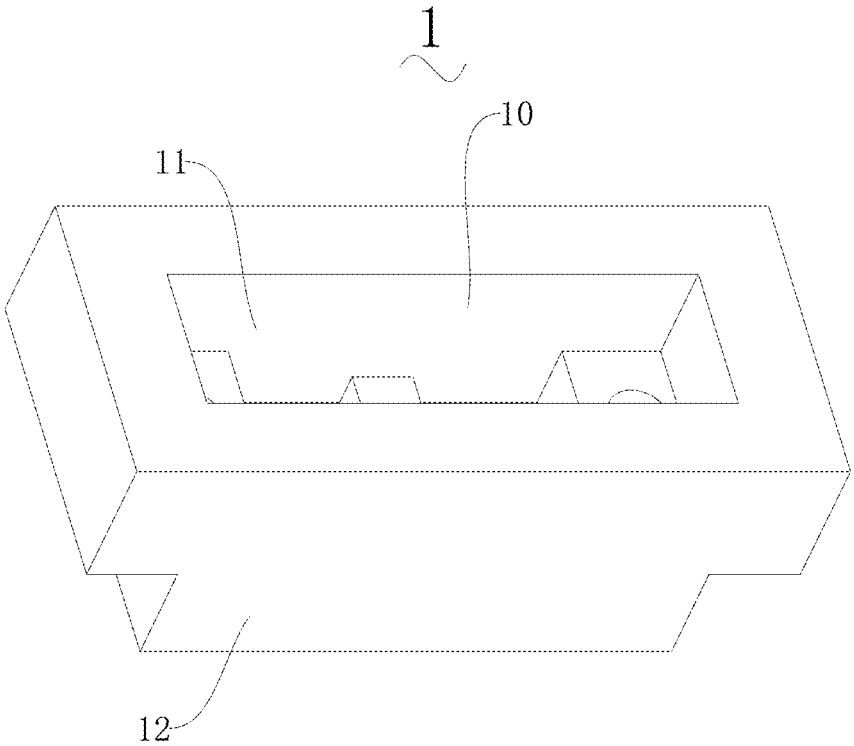
FIG. 6 is a schematic structural view of a liquid conducting member in a second embodiment of the present disclosure.
Figure 7:
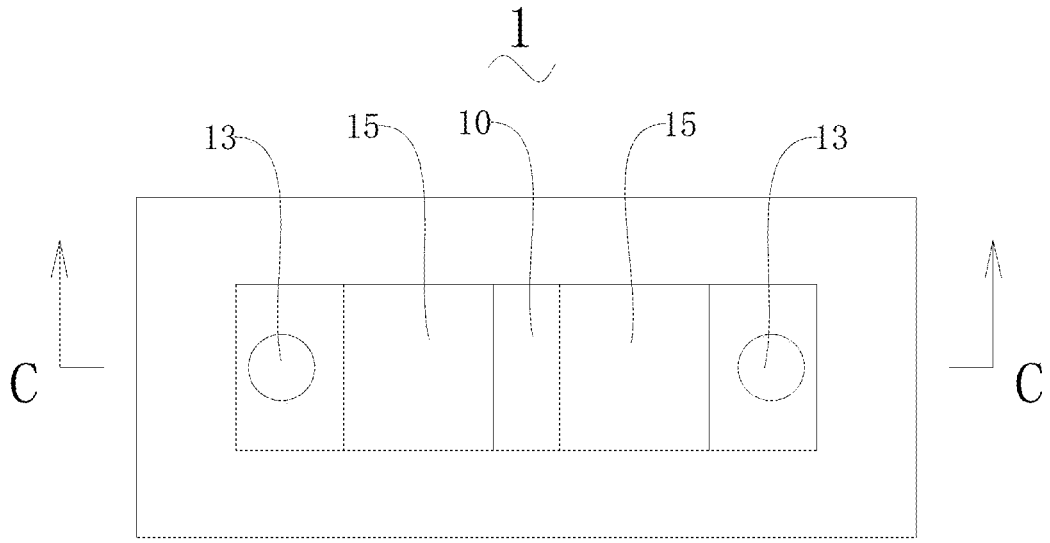
FIG. 7 is a top view of the liquid conducting member in FIG. 56.
Figure 8:
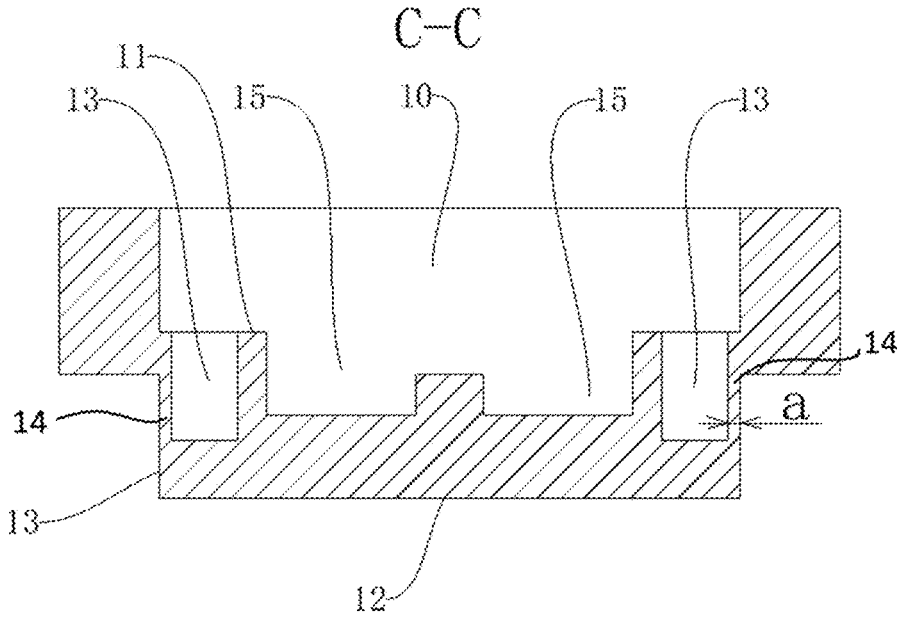
FIG. 8 is a C-C sectional view of FIG. 6.

Referring to FIGS. 6-8, in this embodiment, the thin-wall 14 is a wall between a side wall of the air exchange recess 13 and the outer side 12 of the liquid conducting member 1. Herein, a size of one end of the liquid conducting member 1 provided with the liquid storage groove is larger than that of the opposite end of the liquid conducting member 1, so that the liquid conducting member 1 is in a stepped shape. In the embodiment of FIGS. 6-8, the liquid storage groove is defined in the upper side of the liquid conducting member 1, and the size of the upper end of the liquid conducting member 1 is larger than that of the lower end of the liquid conducting member 1. In this way, the thin-wall 14 can be formed between the air exchange recess 13 and the side wall, to ensure the separation of the air flow and the liquid flow, so as to avoid affecting the transmission of the liquid 3 to the heating member 2 caused by the air occupying the capillary micropores for the liquid 3.

Figure 9:
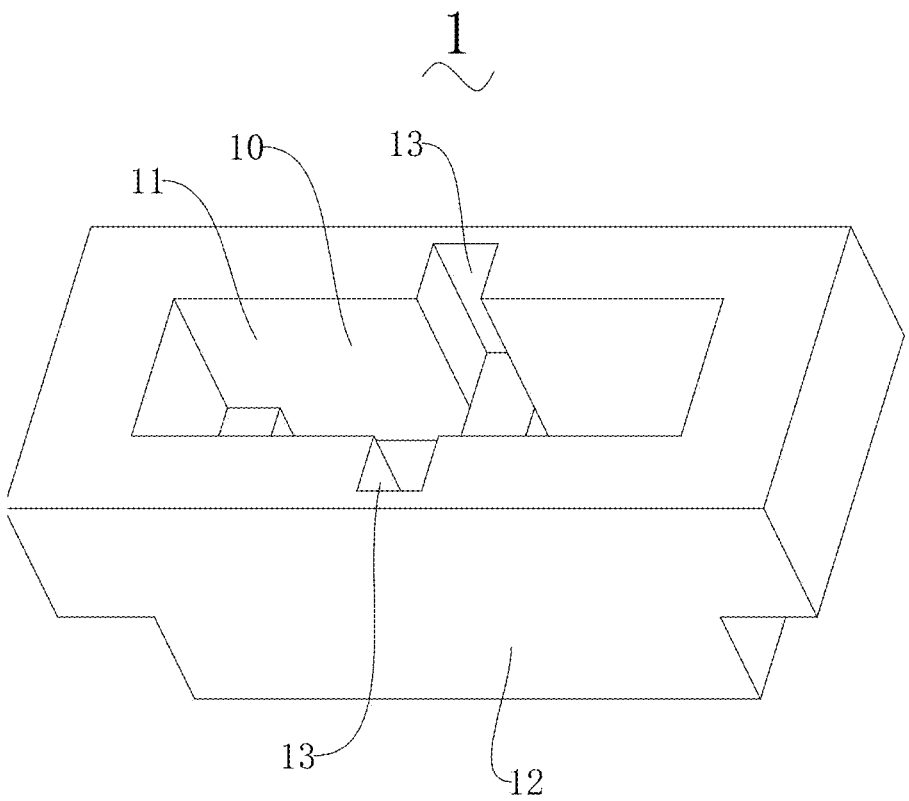
FIG. 9 is a schematic structural view of a liquid conducting member in a third embodiment of the present disclosure.
Figure 10:
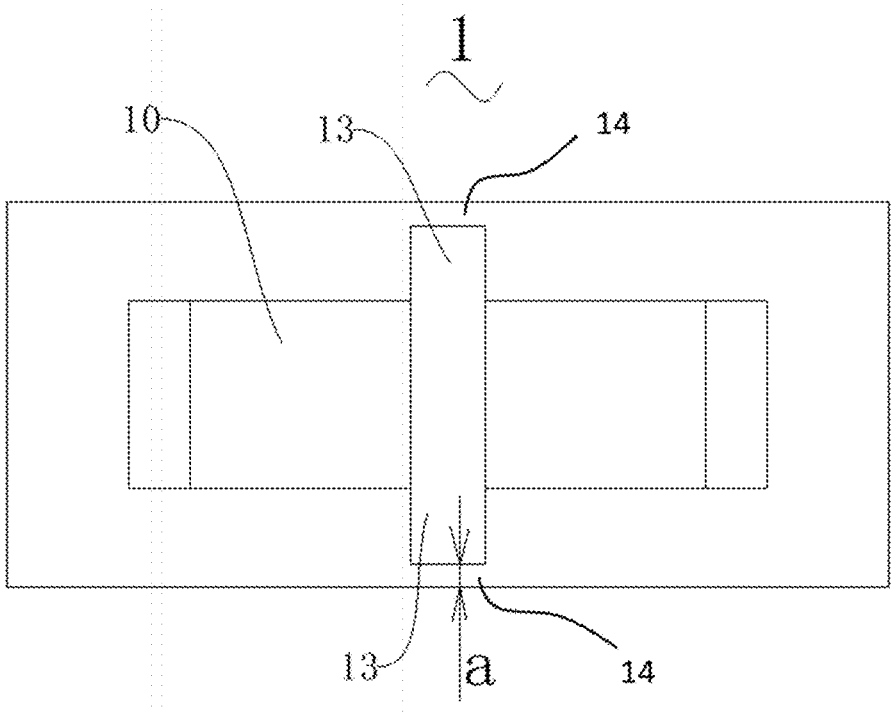
FIG. 10 is a top view of the liquid conducting member in FIG. 9.
Figure 11:
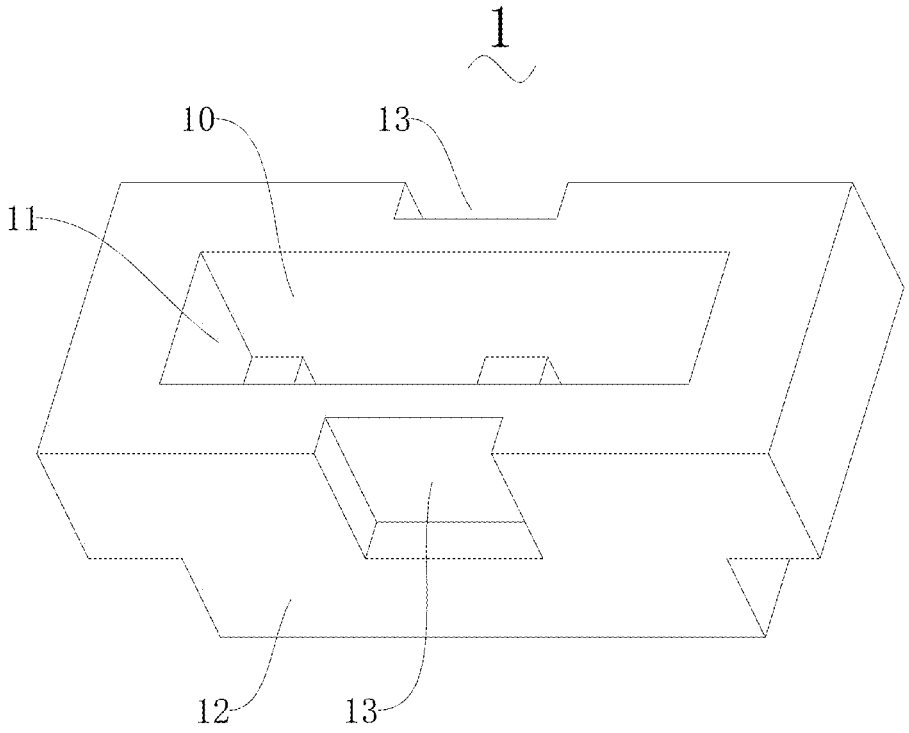
FIG. 11 is a schematic structural view of a liquid conducting member in a fourth embodiment of the present disclosure.
Figure 12:
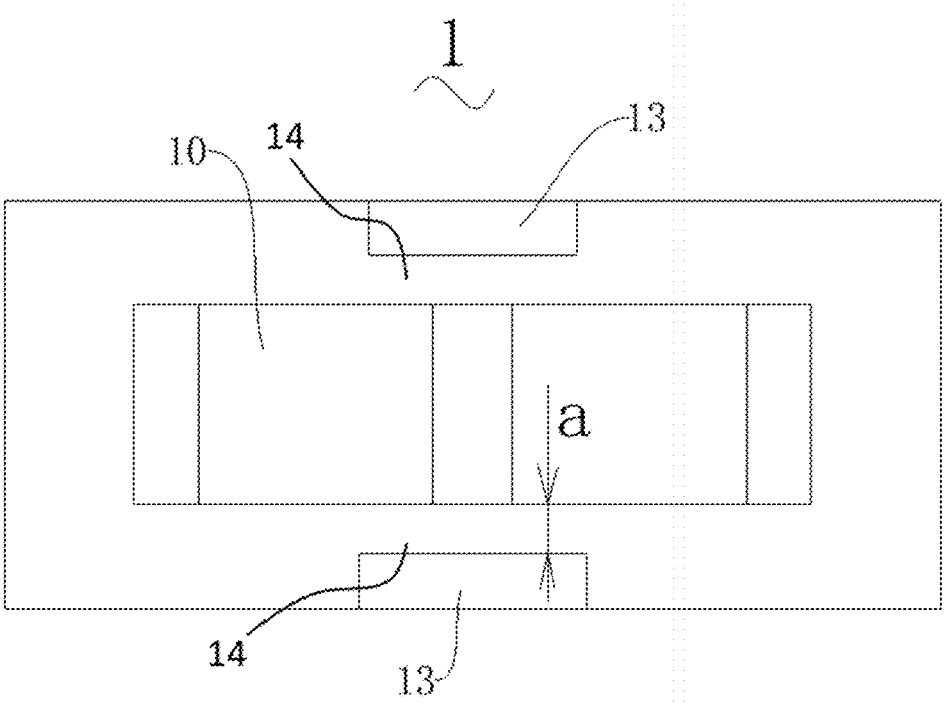
FIG. 12 is a top view of the liquid conducting member in FIG. 11.

Referring to FIGS. 9-10, in this embodiment, the air exchange recess 13 is defined in a side wall of the liquid storage groove, and the air exchange recess 13 is in a hole or groove shape, so that the thin-wall 14 of the liquid conducting member 1 has fewer porous channels, so that the external airflow can better enter the liquid conducting member 1.

Figure 13:
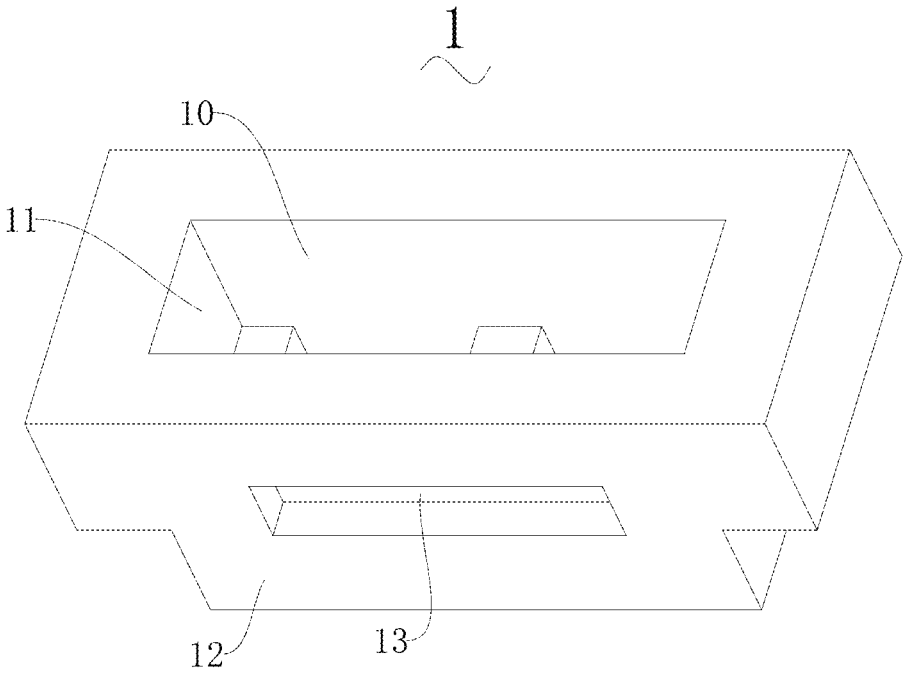
FIG. 13 is a schematic structural view of a liquid conducting member in a fifth embodiment of the present disclosure.
Figure 14:
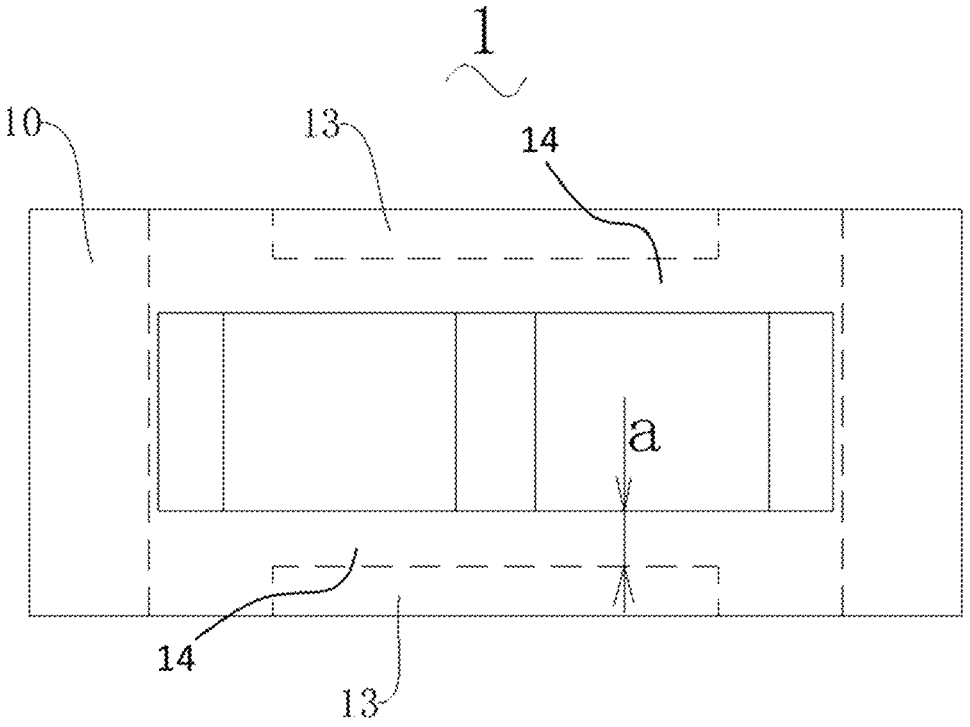
FIG. 14 is a top view of the liquid conducting member in FIG. 13.
Figure 15:
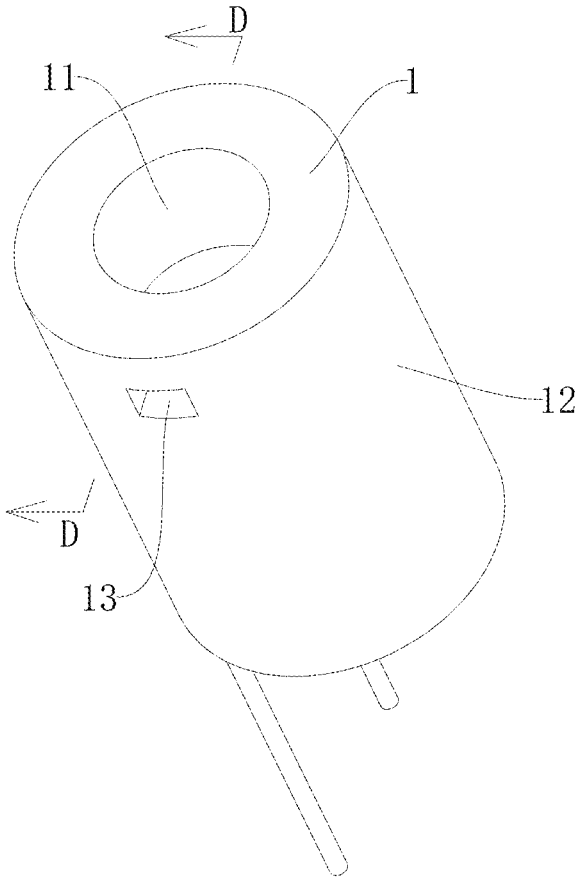
FIG. 15 is a schematic structural view of a liquid conducting member and a heating member in a sixth embodiment of the present disclosure.
Figure 16:
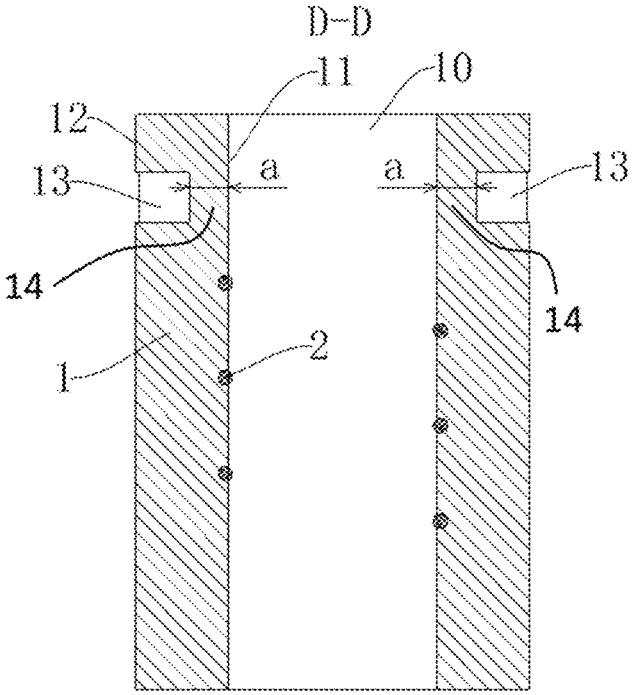
FIG. 16 is a D-D sectional view of FIG. 15.
Figure 17:
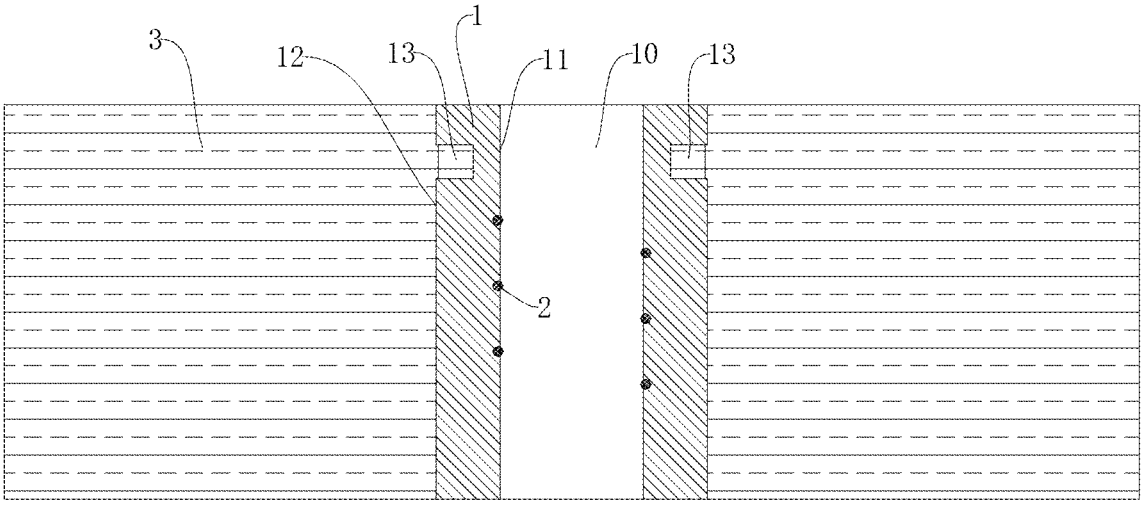
FIG. 17 is a state diagram showing the liquid conducting member and the heating member of FIG. 16 are in contact with the liquid.

Referring to FIGS. 11-14, in these embodiments, the air exchange recess 13 is defined in an outer side of the liquid conducting member 1, and the air exchange recess 13 is a hole or a groove, so that the thin-wall 14 on the liquid conducting member is communicated with the upper side of the liquid conducting member 1 (see FIGS. 11-12), or is isolated from the upper side of the liquid conducting member 1 (see FIGS. 13-14). Thereby, the external air can enter from the thin-wall 14 instead of from the bottom of the heating member 2, so as to avoid the air occupying the liquid inlet channel, and to ensure sufficient liquid supply.

Figure 18:
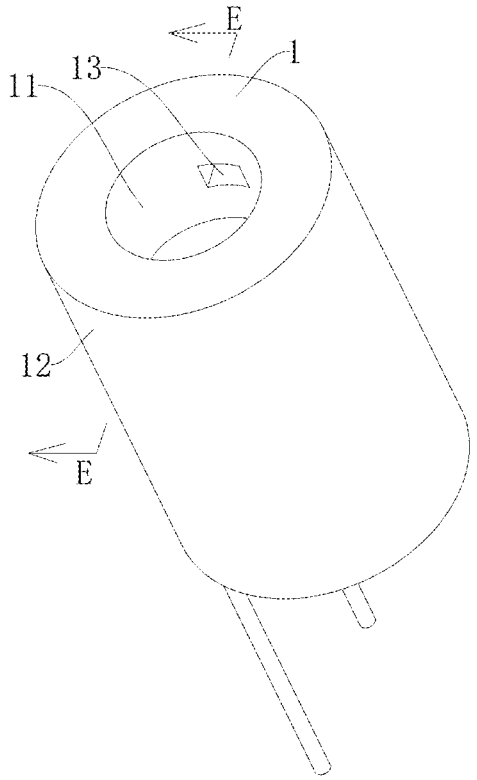
FIG. 18 is a schematic structural view of a liquid conducting member and a heating member in a seventh embodiment of the present disclosure.
Figure 19:
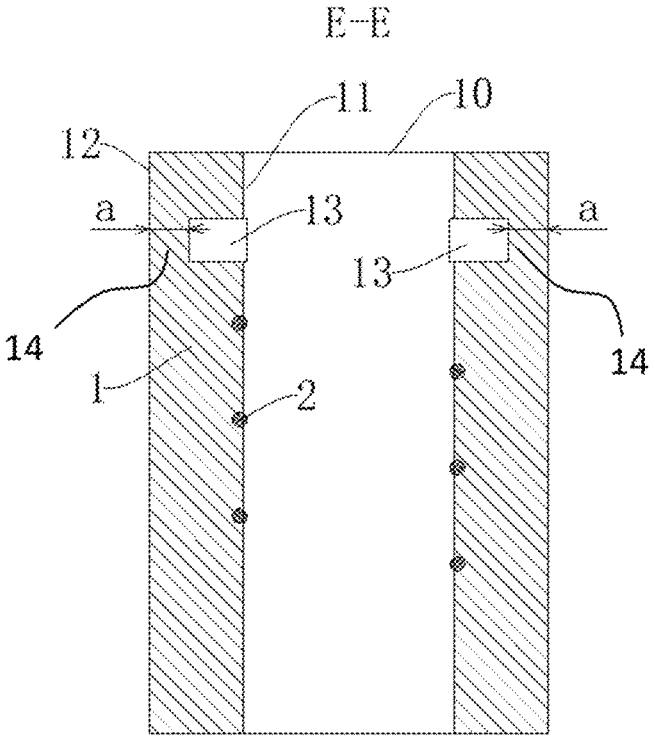
FIG. 19 is an E-E sectional view of FIG. 18.
Figure 20:
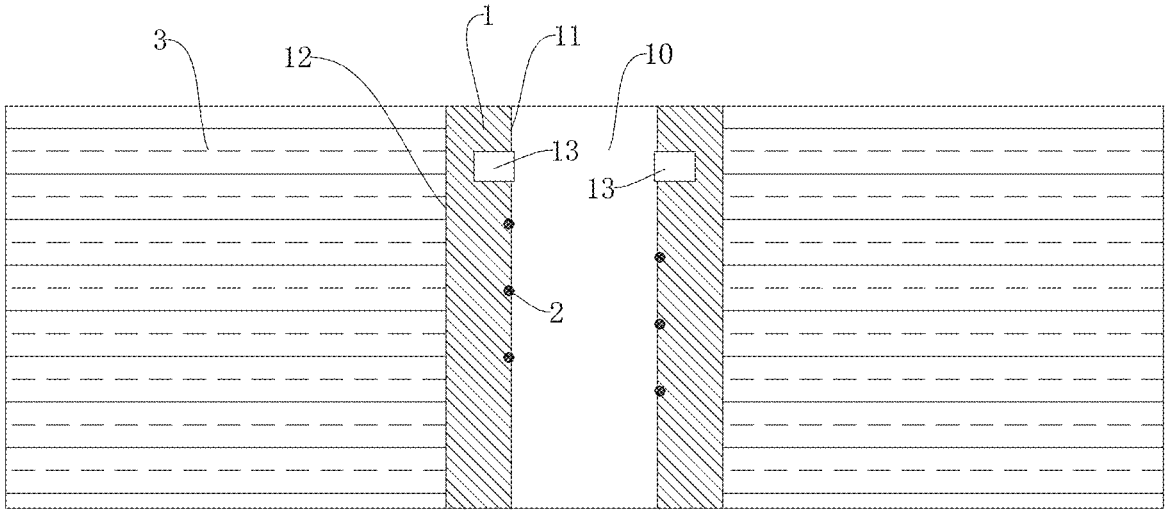
FIG. 20 is a state diagram showing the liquid conducting member and the heating member of FIG. 19 are in contact with the liquid.

Referring to FIGS. 15-20, in these embodiments, the hollow cavity 10 extends through the liquid conducting member 1 from the upper side to the lower side thereof, thus the liquid conducting member 1 is tubular or annular, and the air exchange recess 13 is defined in the outer wall of the liquid conducting member 1 (see FIGS. 15-17) or the inner wall of the liquid conducting member 1 (see FIGS. 18-20). When a pressure difference is formed between the inside and the outside of the liquid conducting member 1, the air enters the hollow cavity 10 in the liquid conducting member 1 for storing liquid through the thin-wall 14, so as to avoid the occupation of the porous channels for the liquid 3 when the air enters the hollow cavity 10, and ensure a sufficient supply of the liquid 3.

For the above embodiments, a thickness of each thin-wall 14 formed by each corresponding air exchange recess 13 is 0.1 mm to 0.5 mm, and an area of each thin-wall 14 formed by each corresponding air exchange recess 13 is 0.05-15 $mm^2$, a porosity of the liquid conducting member 1 is 20% to 80%, and an average micropore diameter of the liquid conducting member 1 is 5 μm to 50 μm.

Figure 3:
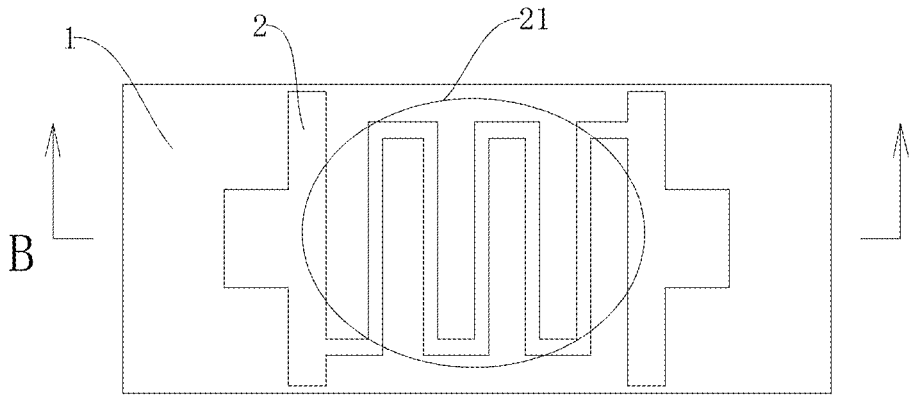
FIG. 3 is a bottom view of a heating assembly in an embodiment of the present disclosure.
Figure 4:
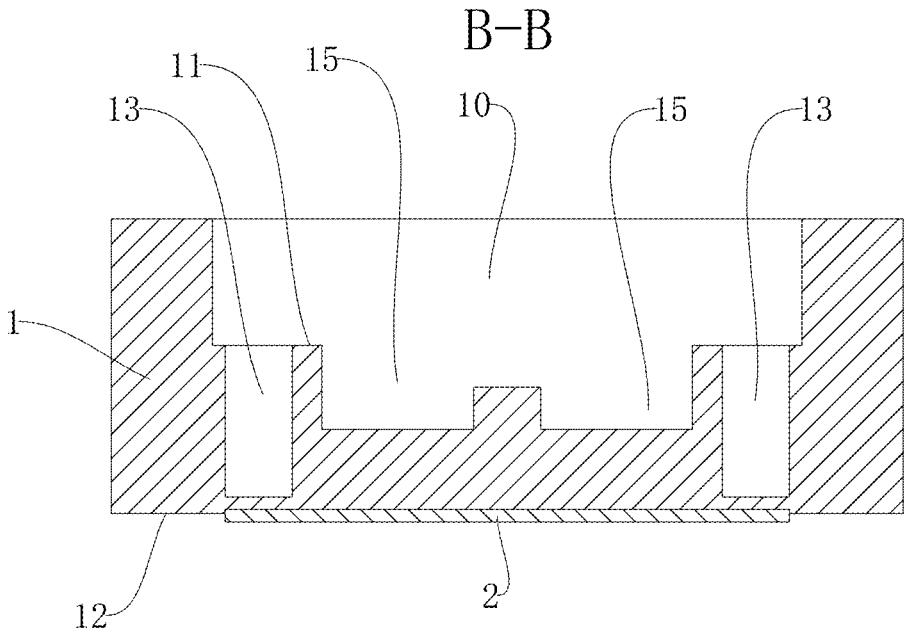
FIG. 4 is a B-B sectional view of FIG. 3.

Referring to FIGS. 3-5, a heating assembly according to an embodiment of the disclosure includes the above-mentioned porous liquid conducting member 1 with a smooth liquid conduction, and further includes a heating member 2 arranged on the liquid conducting member 1. The heating area 21 of the heating member 2 is not located at the thin-wall 14 formed by the air exchange recess 13, in other words, the heating area 21 of the heating member 2 is staggered with the thin-wall 14 formed by the air exchange recess 13. The heating assembly can be applied in an atomizing device, the heating area 21 of the heating member 2 is located at a position staggered from the thin-wall 14, the inner side 11 or the outer side 12 of the liquid conducting member 1 is configured to be in contact with the liquid 3 in the liquid storage chamber of the atomizing device, and the liquid conducting member 1 transmits the liquid 3 to the heating member 2 for heating and atomizing. Since the liquid 3 in the liquid storage chamber will be consumed during the atomizing process of the atomizing assembly, and the liquid storage chamber is in a sealed state, a space in the liquid storage chamber becomes larger and an internal air pressure in the liquid storage chamber becomes smaller than an external atmospheric pressure with the consumption of the liquid 3. Besides, the air can only enter the liquid storage chamber via the porous channels in the porous liquid conducting member 1. With the air exchange recess 13, the air will enter the liquid storage chamber through the thin-wall 14 of the air exchange recess 13, so as to avoid the porous channels in the liquid conducting member 1 at the heating area 21 from being occupied by the air when the air enters the liquid storage chamber, so that all the micropores in the liquid conducting member 1 corresponding to the heating area 21 are used to transfer the liquid 3, so as to achieve a more smooth liquid conduction in the heating area 21. The principle is that at the thin-wall 14 formed by the air exchange recess 13 of the porous liquid conducting member 1, the thickness of the thin-wall 14 is small, and thus the length of each porous channel is small, therefore the external air can enter the liquid storage chamber via the porous channels in the thin-wall 14 when the pressure difference between the liquid storage chamber and the external air is relatively small.

An atomizing device according to an embodiment of the disclosure includes a housing and the above-mentioned heating assembly disposed in the housing. A liquid storage chamber is defined in the housing, and is communicated with the hollow cavity 10 in the liquid conducting member 1, so that the liquid in the liquid storage chamber can enter the hollow cavity 10, and is further conducted to the heating member 2 through the liquid conducting member 1, and the air can enter the liquid storage chamber through the air exchange recess 13. In the atomizing device, the heating area 21 of the heating member 2 is located at a position staggered from the thin-wall 14, the inner side 11 or the outer side 12 of the liquid conducting member 1 is configured to be in contact with the liquid 3 in the liquid storage chamber of the atomizing device, and the liquid conducting member 1 transmits the liquid 3 to the heating member 2 for heating and atomizing. Since the liquid 3 in the liquid storage chamber will be consumed during the atomizing process of the atomizing assembly, and the liquid storage chamber is in a sealed state, a space in the liquid storage chamber becomes larger and an internal air pressure in the liquid storage chamber becomes smaller than an external atmospheric pressure with the consumption of the liquid 3. Besides, the air can only enter the liquid storage chamber via the porous channels in the porous liquid conducting member 1. With the air exchange recess 13, the air will enter the liquid storage chamber through the thin-wall 14 of the air exchange recess 13, so as to avoid the porous channels in the liquid conducting member 1 at the heating area 21 from being occupied by the air when the air enters the liquid storage chamber, so that all the micropores in the liquid conducting member 1 corresponding to the heating area 21 are used to transfer the liquid 3, so as to achieve a more smooth liquid conduction in the heating area 21. The principle is that at the thin-wall 14 formed by the air exchange recess 13 of the porous liquid conducting member 1, the thickness of the thin-wall 14 is small, and thus the length of each porous channel is small, therefore the external air can enter the liquid storage chamber via the porous channels in the thin-wall 14 when the pressure difference between the liquid storage chamber and the external air is relatively small.

The above embodiments illustrate only the preferred embodiments of the present disclosure, of which the description is made in a specific and detailed way, but should not be thus construed as being limiting to the scope of the claims of present disclosure. Those having ordinary skill of the art may freely make combinations of the above-described technical features and make contemplate certain variations and improvements, without departing from the idea of the present disclosure, and all these are considered within the coverage scope of the claims of the present disclosure.

What is claimed is:

1. A porous liquid conducting member with a smooth liquid conduction, the liquid conducting member (1) being provided with a hollow cavity (10) therein, and comprising an inner side (11) and an outer side (12); wherein the inner side (11) or the outer side (12) is configured to be in contact with a liquid, and is provided with an air exchange recess (13) to form a thin-wall (14) on the liquid conducting member (1); a wall thickness of the thin-wall (14) is smaller than a wall thickness between the inner side (11) and the outer side (12), enabling air to be conducted through the thin-wall (14); the hollow cavity (10) is a liquid storage groove defined in an upper side of the liquid conducting member (1); the air exchange recess (13) is located in a bottom of the liquid storage groove; a liquid supply hole (15) is provided in a bottom of the liquid storage groove, and the liquid supply hole (15) is a blind hole; and the wall thickness (a) of the thin-wall (14) formed by the air exchange recess (13) is smaller than a wall thickness (b) between a bottom of the liquid supply hole (15) and an outer side of the liquid conducting member (1).

2. The porous liquid conducting member with the smooth liquid conduction according to claim 1, wherein the thin-wall (14) is a wall between a bottom of the air exchange recess (13) and a lower surface of the liquid conducting member (1).

3. The porous liquid conducting member with the smooth liquid conduction according to claim 1, wherein the thin-wall (14) is a wall between a side wall of the air exchange recess (13) and the outer side (12) of the liquid conducting member (1).

4. The porous liquid conducting member with the smooth liquid conduction according to claim 3, wherein a size of one end of the liquid conducting member (1) provided with the liquid storage groove is larger than that of an opposite end of the liquid conducting member (1), so that the liquid conducting member (1) is in a stepped shape.

5. The porous liquid conducting member with the smooth liquid conduction according to claim 1, wherein the air exchange recess (13) is located in a side wall of the liquid storage groove; or alternatively, the air exchange recess (13) is located in an outer side of the liquid conducting member (1).

6. The porous liquid conducting member with the smooth liquid conduction according to claim 1, wherein the hollow cavity (10) extends through the liquid conducting member (1), and the liquid conducting member (1) is tubular or annular, and the air exchange recess (13) is located in an outer side wall or an inner side wall of the liquid conducting member (1).

7. The porous liquid conducting member with the smooth liquid conduction according to claim 1, wherein the wall thickness of the thin-wall (14) formed by the air exchange recess (13) is 0.1 mm to 0.5 mm; and an area of each thin-wall (14) formed by each corresponding air exchange recess (13) is 0.05-15 $mm^2$.

8. The porous liquid conducting member with the smooth liquid conduction according to claim 1, wherein a porosity of the liquid conducting member (1) is 20% to 80%; and wherein an average micropore diameter of the liquid conducting member (1) is 5 μm to 50 μm.

9. A heating assembly, comprising a porous liquid conducting member (1) with a smooth liquid conduction and a heating member (2) disposed on the liquid conducting member (1); wherein the liquid conducting member (1) is provided with a hollow cavity (10) therein, and comprises an inner side (11) and an outer side (12); the inner side (11) or the outer side (12) is configured to be in contact with a liquid, and is provided with an air exchange recess (13) to form a thin-wall (14) on the liquid conducting member (1); a wall thickness of the thin-wall (14) is smaller than a wall thickness between the inner side (11) and the outer side (12), enabling air to be conducted through the thin-wall (14); and a heating area (21) of the heating member (2) is not located at the thin-wall (14) formed by the air exchange recess (13).

10. An atomizing device, comprising a housing and a heating assembly disposed in the housing; wherein the heating assembly comprises a porous liquid conducting member (1) with a smooth liquid conduction and a heating member (2) disposed on the liquid conducting member (1); wherein the liquid conducting member (1) is provided with a hollow cavity (10) therein, and comprises an inner side (11) and an outer side (12); the inner side (11) or the outer side (12) is configured to be in contact with a liquid, and is provided with an air exchange recess (13) to form a thin-wall (14) on the liquid conducting member (1); a wall thickness of the thin-wall (14) is smaller than a wall thickness between the inner side (11) and the outer side (12), enabling air to be conducted through the thin-wall (14); and a heating area (21) of the heating member (2) is not located at the thin-wall (14) formed by the air exchange recess (13); and wherein a liquid storage chamber is defined in the housing, and is communicated with the hollow cavity (10) in the liquid conducting member (1), so that liquid in the liquid storage chamber can enter the hollow cavity (10) and is further conducted to the heating member (2) through the liquid conducting member (1), and air can enter the liquid storage chamber through the air exchange recess (13).

11. The heating assembly according to claim 9, wherein the hollow cavity (10) is a liquid storage groove defined in an upper side of the liquid conducting member (1).

12. The heating assembly according to claim 11, wherein the air exchange recess (13) is located in a bottom of the liquid storage groove; a liquid supply hole (15) is provided in a bottom of the liquid storage groove, and the liquid supply hole (15) is a blind hole; and the wall thickness (a) of the thin-wall (14) formed by the air exchange recess (13) is smaller than a wall thickness (b) between a bottom of the liquid supply hole (15) and an outer side of the liquid conducting member (1).

13. The heating assembly according to claim 12, wherein the thin-wall (14) is a wall between a bottom of the air exchange recess (13) and a lower surface of the liquid conducting member (1).

14. The heating assembly according to claim 12, wherein the thin-wall (14) is a wall between a side wall of the air exchange recess (13) and the outer side (12) of the liquid conducting member (1).

15. The heating assembly according to claim 14, wherein a size of one end of the liquid conducting member (1) provided with the liquid storage groove is larger than that of an opposite end of the liquid conducting member (1), so that the liquid conducting member (1) is in a stepped shape.

16. The heating assembly according to claim 11, wherein the air exchange recess (13) is located in a side wall of the liquid storage groove; or alternatively, the air exchange recess (13) is located in an outer side of the liquid conducting member (1).

17. The heating assembly according to claim 9, wherein the hollow cavity (10) extends through the liquid conducting member (1), and the liquid conducting member (1) is tubular or annular, and the air exchange recess (13) is located in an outer side wall or an inner side wall of the liquid conducting member (1).

18. The atomizing device according to claim 10, wherein the wall thickness of the thin-wall (14) formed by the air exchange recess (13) is 0.1 mm to 0.5 mm.

* * * * *